US007481435B2

(12) United States Patent
Shetterly

(10) Patent No.: US 7,481,435 B2
(45) Date of Patent: Jan. 27, 2009

(54) PLAYING CARDS WITH DUAL NUMBER FEATURE

(75) Inventor: Bryan K Shetterly, Birmingham, MI (US)

(73) Assignee: Leveraged Gaming Corporation, Bloomfield Hills, MI (US)

( * ) Notice: Subject to any disclaimer, the term of this patent is extended or adjusted under 35 U.S.C. 154(b) by 473 days.

(21) Appl. No.: 11/229,453

(22) Filed: Sep. 16, 2005

(65) Prior Publication Data

US 2007/0063441 A1 Mar. 22, 2007

(51) Int. Cl.
*A63F 1/00* (2006.01)

(52) U.S. Cl. ..... 273/307; 273/303; 273/304; 273/306; D21/379; D21/378; D21/376

(58) Field of Classification Search ..... 273/303–307, 273/292, 293; D21/376, 378–384
See application file for complete search history.

(56) References Cited

U.S. PATENT DOCUMENTS 681,925 A * 9/1901 O'Neill ..... 273/304
712,566 A 11/1902 Moller
821,781 A 5/1906 Cadwallader
1,551,761 A 9/1925 McCarroll
1,693,525 A 11/1928 Niederlitz
1,798,672 A 3/1931 Hines
4,170,358 A 10/1979 Hancock
4,588,193 A 5/1986 Winston
5,280,916 A 1/1994 Gleason, Jr.
5,782,473 A * 7/1998 Chou et al. ..... 273/292
5,836,586 A * 11/1998 Marks et al. ..... 273/292
6,132,311 A * 10/2000 Williams ..... 463/13

FOREIGN PATENT DOCUMENTS

CA 261488 6/1926

* cited by examiner

*Primary Examiner*—Benjamin H Layno
(74) *Attorney, Agent, or Firm*—Faegre & Benson LLP

(57) ABSTRACT

The construction of a set of playing cards comprising a group of single-valued cards and a group of double-valued cards is disclosed. In one embodiment, the power of a select group of conventionally high value cards is shifted to a select group of conventionally low value cards. Methods of using the disclosed sets of playing cards for increasing the probability of a winning hand in a game of cards are also described.

54 Claims, 4 Drawing Sheets

PLAYING CARDS WITH DUAL NUMBER FEATURE

TECHNICAL FIELD

The present invention relates to playing cards. More particularly, this invention relates to a set of playing cards in which some of the individual cards represent two different values and/or suits.

BACKGROUND

Decks of playing cards comprising 52 cards, each denoting a different value from deuce through ace of one of four suits (clubs, diamonds, hearts, and spade), herein referred to as the standard deck, are well known in the art. The use of such standard decks to play a wide variety of card games is also well known in the art. A fact associated with playing a card game with a standard deck is the shortage of high value cards which must be shared between the players. Hands that offer a promise of winning are limited to the least poor hand in the game. While each card of a standard deck must be played at the value indicated on its face, wild cards may be introduced into the game in an attempt to improve the proportion of high value cards.

There have been many proposals in the past for new and different layouts and/or kinds of playing cards for playing new games, variations of old games, etc. One well-known alteration of the standard deck has been to provide a set of cards in which each individual card represents more than one value, as indicated on its face. Such double-valued cards may be used in a game for various purposes. For example, a card that is valued as both an ace and a six can be played as either to the best advantage of the player holding the card.

U.S. Pat. No. 821,781 to Cadwallader discloses a set of cards with double or multiple alternative card values on the face of each individual card, which values may comprise different values of one suit or they may comprise the same or different values of different suits, and from which values one card value may be selected for play as desired by the player. During play, the individual suits may be designated as either major or subordinate suits.

Canadian Patent Number 261,488 to McCarroll describes a deck of cards in which each card has on its face an inner portion representing one card value, and a perimetric outer portion representing a different card value. The set essentially consists of two sets, each comprising a full set of 52 cards, but the physical set having only 52 cards in all. In a card game, the players may elect to play either the inner card value or the outer card value. Similarly, U.S. Pat. No. 1,693,525 to Niederlitz discloses a deck of 52 cards having eight different suits represented by inner and outer zones of different values and suits.

A deck of double-valued cards, designed so that every number value of a given suit is paired once with every number value of the other suits, is described in U.S. Pat. No. 4,588,193 to Winston. The deck comprises 60 double-valued cards consisting of three different suits with four different number values per suit, and twelve half-wild cards consisting of a fifth number value which is wild in terms of its suit.

U.S. Pat. No. 1,798,672 to Hines illustrates a deck of cards with a diagonal strip dividing each card into two areas bearing different designations and colors. Another alternative form of a deck with double-valued cards is disclosed in U.S. Pat. No. 1,551,761 to McCarroll.

In U.S. Pat. No. 4,170,358, Hancock reveals a deck of 52 cards wherein 48 cards are configured as double-valued cards having two zones with each zone assigned a card value ranging from three through ace configured such that the card value in one zone is distinctly different from the card value in the other zone. The four residual cards, though divided into two distinct zones, nevertheless are single-value cards representing in each zone the same suit deuce of a standard deck. By assigning a color to one of the zones of each card and a distinctly different color to the other zone of each card, the 52 card deck of '358 essential yields two standard decks, one of which may be designated as a major deck and the other as a minor deck.

SUMMARY OF THE INVENTION

The present invention discloses new sets of playing cards wherein some of the cards are single-valued cards and other cards are multi-valued cards.

In one such embodiment of the present invention, the face of each multi-valued card comprises at least two distinct zones yielding a double-valued card. Each single-valued card and each zone of each double-valued card includes an indicia representing a card value selected from the group deuce through ace of a suit selected from club, spade, diamond, and heart.

One embodiment of the present invention comprises a set of playing cards wherein the card values assigned to each zone of each double-valued card is such that the arithmetic total of the values in each zone equals eleven for each card.

Embodiments of various methods in which a set of playing cards of the present invention may be used for effectuating the outcome of a game and/or the overall value of one or more hands are disclosed.

While multiple embodiments are disclosed, still other embodiments of the present invention will become apparent to those skilled in the art from the following detailed description, which shows and describes a few illustrative embodiments of the invention. As will be realized, the invention is capable of modifications in various aspects, all without departing from the spirit and scope of the present disclosure. Accordingly, the drawings and detailed description are to be regarded as illustrative in nature and not restrictive.

DETAILED DESCRIPTION

In a set of playing cards comprising a group of double-valued cards, there are several possibilities for arranging the zones or areas in which the two card values can be allocated. Five such alternative zone arrangements for an embodiment of the present invention are shown in FIG. 1.

Figure 1B:
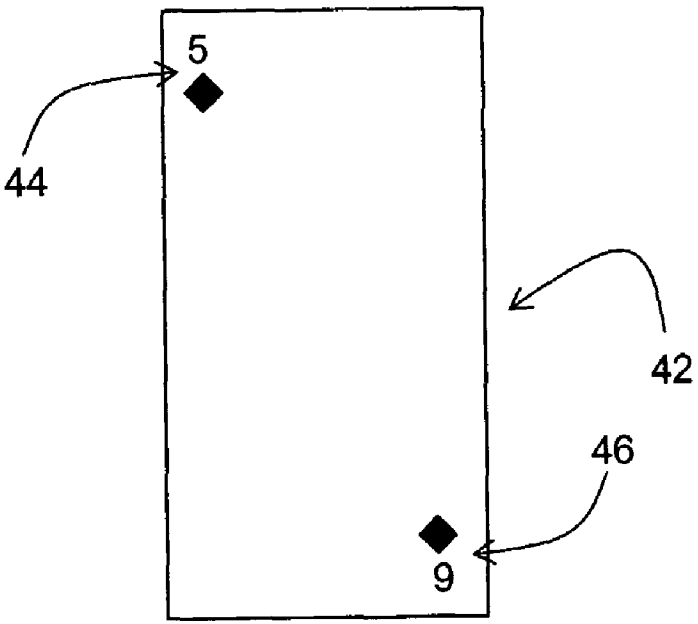
FIGS. 1*a*-1*e* show alternative arrangements on a face of a double-valued card in a set of playing cards for different embodiments of the present invention.
Figure 1A:
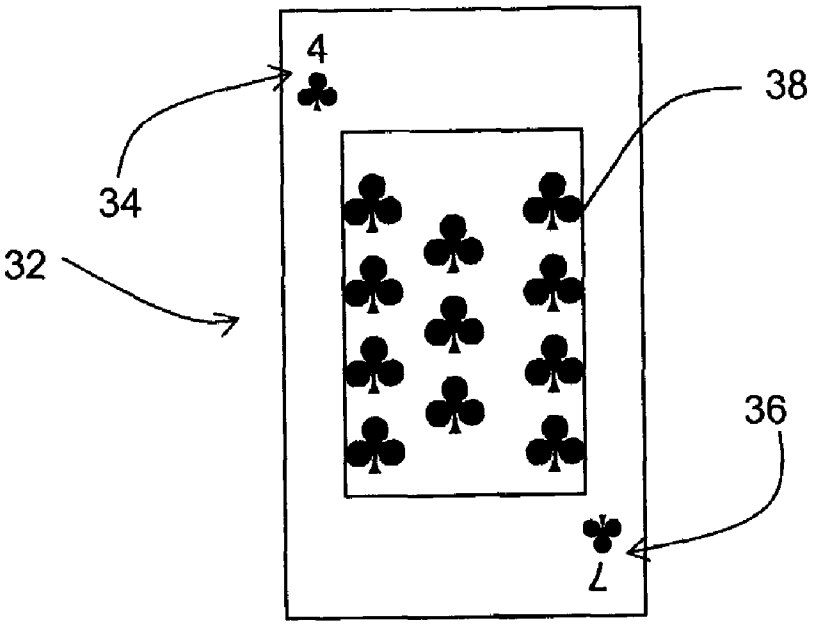

In FIG. 1*a*, an embodiment of double-valued card 32 includes zones 34 and 36 for indicating the card values. As shown, zone 34 has been allocated the card value indicative of the four of clubs, and zone 36 has been assigned the card value indicative of the seven of clubs. Double-valued card 32 may also include area 38 encompassing eleven indicia representative of the arithmetic total of the card values in zones 34 and 36. For a double-valued card such as that shown in FIG. 1*a*, wherein both card values are of the same suit, clubs in this instance, the eleven indicia in area 38 may be clubs. Subject to the rules of a card game, the card of FIG. 1*a* may be played advantageously as either the seven of clubs or as the four of clubs or as the eleven of clubs.

FIG. 1*b* illustrates an alternate embodiment of double-valued card 42 comprising zones 44 and 46. As shown, the card value five of diamonds has been allocated in zone 44, and the card value six of diamonds has been assigned to zone 46.

Figure 1E:
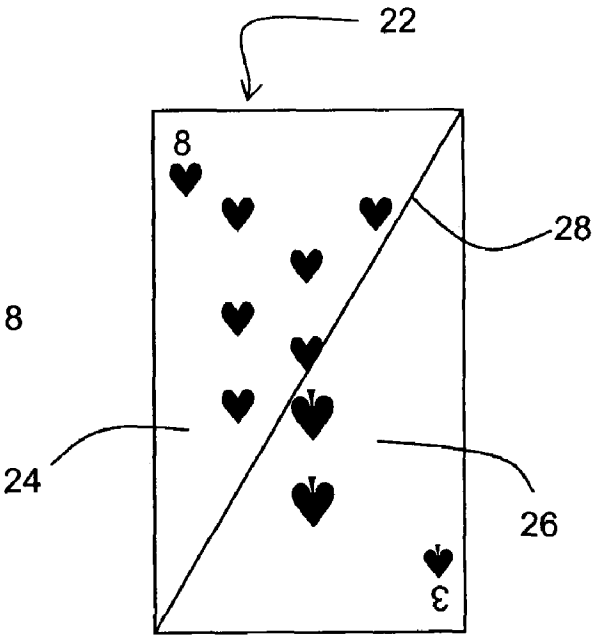
Figure 1D:
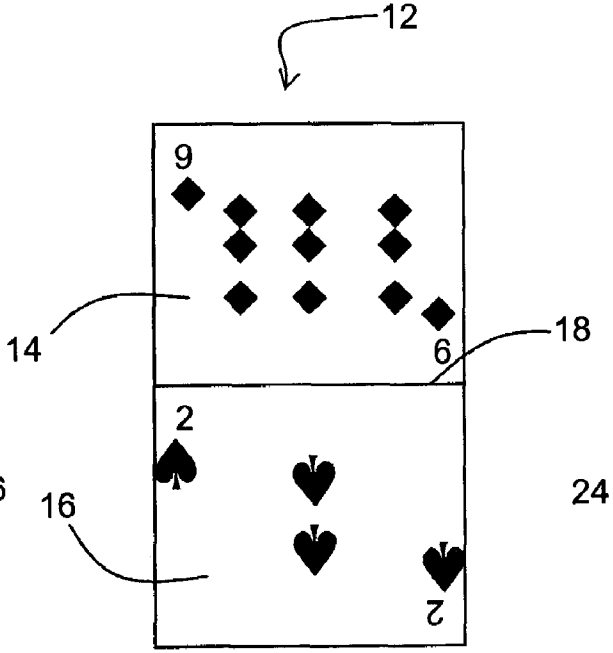
Figure 1C:
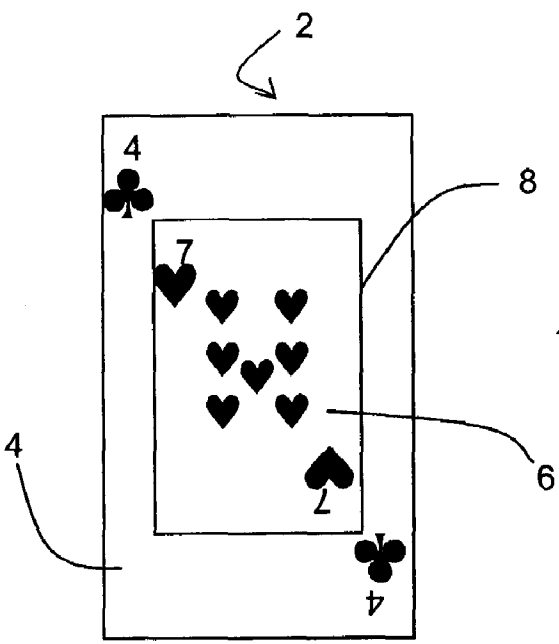

In FIG. 1*c*, an embodiment of double-valued card 2 includes zone 4 surrounding zone 6 enclosed within box 8. As illustrated, zone 4 has been allocated the card value indicative of the four of clubs, and zone 6 has been assigned the card value indicative of the seven of hearts. FIG. 1*d* illustrates an alternate embodiment of double-valued card 12 comprising zone 14 and zone 16 separated by line 18. As shown, the card value nine of diamonds has been allocated to zone 14, and the card value deuce of spades has been assigned to zone 16. FIG. 1*e* shows another embodiment of double-valued card 22 comprising zone 24 and zone 26 separated by line 28. As shown, the card value eight of hearts has been allocated to zone 24, and the card value three of spades has been assigned to zone 26.

With regards to FIG. 1, it should be noted that the physical location of any zone on the face of a double-valued card is merely a matter of choice, and each zone may be located anywhere on the double-valued card. Additionally, the assignment of a specific card value and/or suit to a specific zone is a matter of choice, and that there is no requirement regarding the assignment of a high or low card value or the allocation of a particular suit to a specific zone. Furthermore, box 8 or lines 18 or 28 may not be necessary for distinguishing between the zones and/or for separating them. Various alternative embodiments comprising different shadings, colors, orientation, shape, size, etc., may also be used for distinguishing between the zones. Also, there is no restriction regarding the pairing together of specific suits. However, for each one of the double-valued cards, such as those shown in FIG. 1, the arithmetic total of the card values must equal eleven.

In accordance with an embodiment of the present invention, the arithmetic total of the two card values on a double-valued card must equal eleven. In one embodiment of the present invention the deuce must be paired with the nine, the three must be paired with the eight, the four must be paired with the seven, and the five must be paired with the six.

In another embodiment of the present invention, the suits represented in the zones of a double-valued card may be paired as either the same suit in both zones, or the different but same color suits in each zone, or the different color suits in each zone. However, in an embodiment of the present invention, the paired suit selected for a paired card value must be carried through for all other paired card values for the paired suit, and thereby resulting in two groups of deuce through nine for the paired suits. For example, if the deuce of clubs is paired with the nine of diamonds, then the three of clubs must be paired with the eight of diamonds, the four of clubs must be paired with the seven of diamonds, etc.

In yet another embodiment of the present invention, the suit selected for a specific zone of the double-valued playing card must also be applied to the same zone for all the card values of that suit. By way of example, if the suit clubs is selected for zone 4 in the embodiment of FIG. 1*c*, then the suit clubs must be used in zone 4 for all card values from deuce through nine.

From the foregoing discussion, it will be apparent to one skilled in the art that each card value ranging from deuce through nine of the four suits comprising clubs, spade, diamond, and heart, will be represented twice—once in each of the two zones of a double-valued card.

Figure 2A:
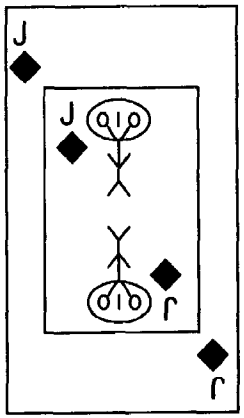
FIGS. 2*a*-2*d* show alternative arrangements on a face of a single-valued card in a set of playing cards for different embodiments of the present invention.
Figure 2B:
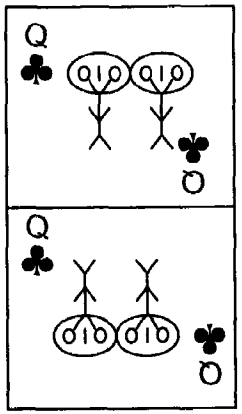
Figure 2C:
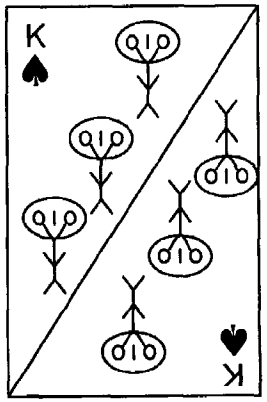

Alternative arrangements on a face of a single-valued card in a set of playing cards for different embodiments of the present invention are shown in FIGS. 2*a*-2*c*. For illustration purposes, the single-valued cards are represented in a double-valued fashion, i.e., they are zoned, in the same way as the double-valued cards of FIGS. 1*c*-1*e*. However, in an embodiment of the present invention, and as illustrated in FIGS. 2*a*-2*c*, the same card value and suit is allocated to both zones of the single-valued card represented in a double-valued fashion. Additionally, for each suit, the single-valued cards are allocated the card values from ten through ace. In a game of cards, the single-valued cards illustrated in FIGS. 2*a*-2*c* maintain the card value and suit associated in any one of the two zones, i.e., the card values associated with each one of the two zones are not additive.

Figure 2D:
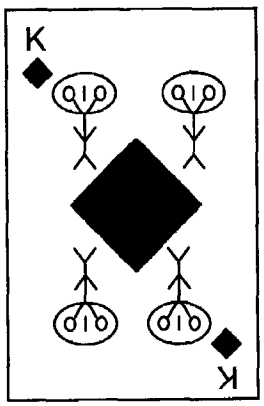

FIG. 2*d* shows another embodiment of a single-valued card which is substantially similar to the cards of a conventional set of playing cards. In an embodiment of the present invention, the single-valued cards are allocated the card values from ten through ace for each suit.

From the foregoing discussions related to FIG. 1 and FIG. 2, it will be apparent to one skilled in the art, that in a set of playing cards constructed in accordance with an embodiment of the present invention, the power of the cards in a set may be shifted from the high value cards to the low value cards. This is accomplished by constructing each one of the low value cards as double-valued cards such that the arithmetic total of the card values on each double-valued card equals eleven. In a set of playing cards in accordance with one embodiment of the present invention, the high and low value cards are respectively considered to be ten through ace and deuce through nine. Thus, it will be obvious to those skilled in the art that the aforementioned shifting of power is accomplished by doubling the number of choices among the deuce through nine cards and not by altering the rank of any card.

It will be further apparent to one skilled in the art, that the power of cards may be shifted to a select number of the low value cards. This may be accomplished in an alternative embodiment wherein the pairing of card values yielding an arithmetic total of eleven is restricted to only the six through nine cards of each suit. In one such embodiment of a set of playing cards, the six is paired with the five, the seven is paired with the four, the eight is paired with the three, and the nine is paired with the deuce. In such an embodiment of a set of playing cards, the deuce through five cards of each suit are not paired, and therefore the probability of being dealt the lowest numbered cards, viz., deuce through five, is increased.

In another embodiment, a set of playing cards may be assembled with card values ranging from six through ace and wherein the six through nine cards are double-valued cards paired with card values deuce through five, and the ten through ace cards are single-valued cards. As in other embodiments of the present invention, the double-valued cards are paired such that the arithmetic total of the card values in the zones of each double-valued cards equals eleven. For example, the six is paired with the five, the seven is paired with the four, the eight is paired with the three, and the nine is paired with the deuce.

Alternatively, a set of double-valued playing cards constructed in accordance with any one of the embodiments of the present invention may include, at each one of the two corners of one of the two short edges of the card, indicia representing one of the two card values and suits. In this instance, the two corners of the second of the two short edges of the card may include indicia representing the second of the two card values and suits. One advantage of cards designed in such a fashion is that it provides a player the option of selectively viewing only those card values and suits selected for playing the instant hand. For example, during play, a player typically holds the cards in a fan-like configuration exposing the playing card values and suits imprinted in the upper left hand corners of the cards which the player has selected for playing the instant hand. Alternatively, the cards may be held in a fan-like configuration exposing the playing card values and suits imprinted in the upper right hand corners of the cards which the player has selected for playing the instant hand. If the player wishes to play the card value and suit indicated on the corners of the opposite short edge of the card, then the card may be rotated 180 degrees.

In a game of cards, the rules of play may be established either before or during the game. In an embodiment of a game of the present invention, the holder of the one or more black suits, for example spades and clubs, may be permitted to play either one of the two card values indicated on the one or more double-valued cards in the player's hand. In an alternate embodiment of a game, the rules of play may be set to force the holder of the one or more red suits, for example hearts or diamonds, to play the lowest card value indicated on the one or more double-valued card in the player's hand. In another embodiment of a game, the holder of the one or more black suits, for example spades and clubs, may be permitted to play either one of the two card values indicated on the one or more double-valued cards in the player's hand while simultaneously forcing the holder of the one or more red suits, for example hearts or diamonds, to play the lowest card value indicated on the one or more double-valued card in the player's hand. In yet another embodiment of a game, the rules of play may be set prohibiting the player from choosing how to play a double-valued card. In such an instance, the player may be required to play, as dealt, the card value and suit in a specific one of the two zones on a double-valued card.

In an embodiment of a game of the present invention, the one or more black suits, for example spades and clubs, may be designated as high and thereby forcing the player to play the higher of the two card values of the one or more black suits indicated on the one or more double-valued card in the player's hand. For instance, in the hand shown in FIG. 3, the player would be required to play the card of FIG. 3*a* as the seven of spade, while advantageously playing the cards of FIGS. 3*b*-3*d*, respectively, as the four of club, the deuce of spade, and the three of spade. The card of FIG. 3*e* may be advantageously played as either the six or the five of diamonds as desired by the player and subject to the rules of the game.

In another embodiment of a game, the one or more red suits, for example hearts or diamonds, may be designated as low and thereby forcing the player to play the lower of the two card values of the one or more red suits indicated on the one or more double-valued card in the player's hand. For the hand shown in FIG. 3, the player would be required to play the card of FIG. 3*e* as the five of diamond, while advantageously playing the cards of FIGS. 3*b*-3*d*, respectively, as the seven of diamond, the nine of diamond, and the eight of heart. The card of FIG. 3*a* may be advantageously played as either the seven of spade or as the four of clubs as desired by the player and subject to the rules of the game.

In an alternate embodiment of a game, the one or more black suits, for example spades and clubs, may be designated as high and thereby forcing the player to play the higher of the two card values of the one or more black suits indicated on the one or more double-valued card in the player's hand, while simultaneously designating the one or more red suits, for example hearts or diamonds, as a low suit and thereby forcing the player to play the lower of the two card values of the one or more red suits indicated on the one or more double-valued card in the player's hand. For example, in the hand of FIG. 3, the player would be required to play the card of FIG. 3*a* as the seven of spade while simultaneously be required to play the card of FIG. 3*e* as the five of diamond. Under this scenario, the cards of FIGS. 3*b*-3*d* may be played advantageously as dictated by the rules of the game and/or in a manner most advantageous to the player.

In an embodiment of a game of the present invention, the one or more black suits, for example spades and clubs, may be designated as high and thereby forcing the player to play the higher of the two card values of the one or more black suits indicated on the one or more double-valued card in the player's hand. For instance, in the hand shown in FIG. 3, the player would be required to play the card of FIG. 3*a* as the seven of spade, while advantageously playing the cards of FIGS. 3*b*-3*d*, respectively, as the four of club, the deuce of spade, and the three of spade. The card of FIG. 3*e* may be advantageously played as either the six or the five of diamonds as desired by the player and subject to the rules of the game.

Figures 3A, 3B, 3C, 3D, 3E:
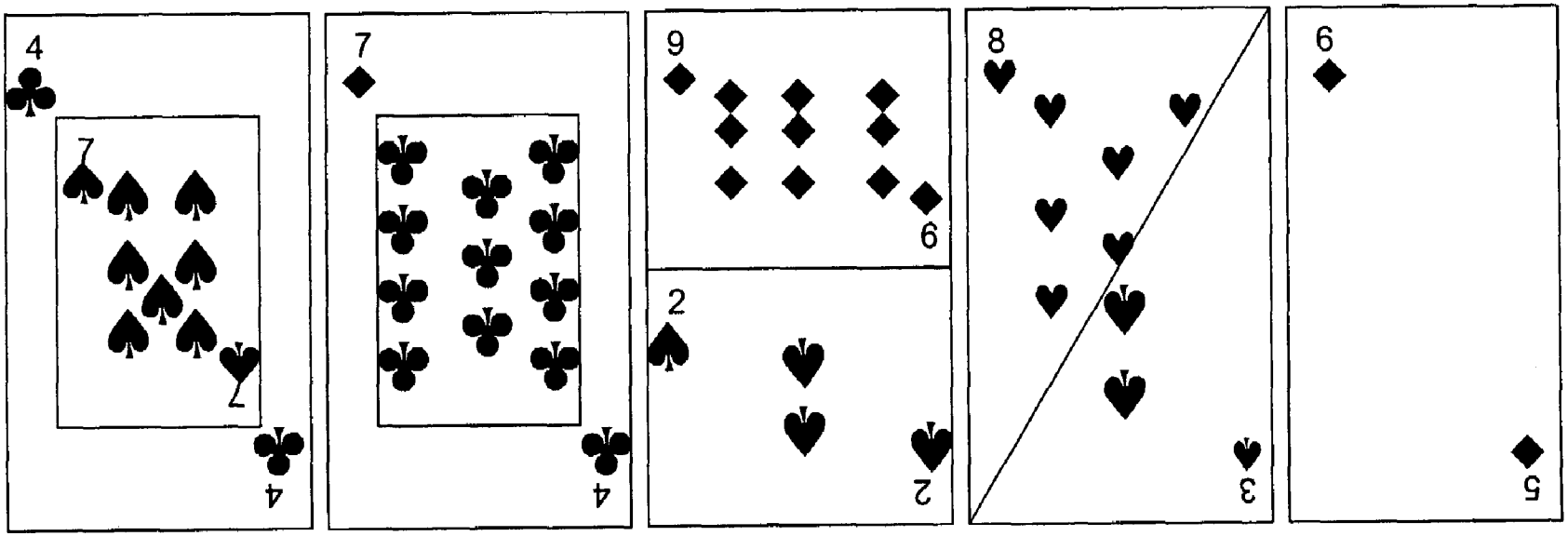
FIGS. 3*a*-3*e* is an illustration of exemplary playing cards in a player's hand.

An embodiment of the present invention may include a device for displaying the cards in one or more hands of one or more games playable on the device using the one or more sets of playing cards of the present invention. The device may also include means useable by a player for effectuating the display. In one such embodiment of the invention, the display may be limited to show only the playing card values and suits selected by the player and/or subject to the rules of the game. For instance, if the player decides to play the card of FIG. 3*a* as the seven of spades, then the device may automatically display the card of FIG. 3*a* as the seven of spades and without any indication that the card was also the four of clubs. Alternatively, the player may use the means provided for effectuating the display. In an alternate embodiment of a game played on a device, the card of FIG. 3*a* may be displayed as the seven of spades in the foreground and as the four of clubs in the background. In another embodiment of the game played on a device, the card of FIG. 3*a* may be displayed with the seven of spades predominating the front face of the card and the four of clubs occupying a relatively insignificant portion of the front face of the card. Alternatively, if the card of FIG. 3*a* is played as the four of clubs, then the four of clubs, and not the seven of clubs, may be displayed in a predominating configuration on the face of the card.

In an embodiment of a device of this invention, means for manipulating the device and effectuating the outcome of a game and/or selecting one or more playing cards may be made available to the player. Means for manipulating the device may include, among other things, a stylus, computer-type-mouse, combination of roller ball and buttons, a joystick, etc. In such a device, the player may manipulate the game-hand by selecting which one of the two card values and suits on a double-valued card should be used in the card game.

Several other alternative modes for displaying the cards of a hand for a game playable on a device are contemplated and are considered to be within the spirit and scope of the present invention. In one embodiment of the invention, the device may be an electronic device such as a computer, a hand-held gaming device, etc. Alternatively, the device may be an electromechanical device, a purely mechanical device, etc.

Various other modifications may be made to the exemplary embodiments discussed hereinbefore without departing from the spirit and scope of the present invention. While the described embodiments refer to particular features, the scope of this invention also includes embodiments having different combinations or features. Accordingly, the present invention is intended to embrace all such alternatives, modifications, and variations as falling within the scope of the appended claims, and all equivalents thereof.

I claim:

1. A set of playing cards comprising:

a first group of cards including single-valued cards wherein each single-valued card includes only one numerical playing card value indicated thereon of a playing card suit selected from club, spade, diamond, and heart; and a second group of cards including double-valued cards wherein each double-valued card includes at least two numerically different playing card values indicated thereon ranging from deuce through nine of one or more playing card suit selected from club, spade, diamond, and heart, wherein the arithmetic total of the at least two playing card values on each one of the double-valued cards equals eleven.

2. The playing cards of claim 1 wherein the playing card values on each one of the double-valued card are from distinctly different playing card suits.

3. The playing cards according to claim 1 wherein, the at least two playing card values on each one of the double-valued cards are of the same playing card suit.

4. The playing cards according to claim 1 wherein each double-valued card is configured to display only one of the two card values on the face of the double-valued card.

5. The playing cards of claim 1 wherein each double-valued card is configured such that only one of the two card values predominates the face of the double-valued card.

6. The playing cards of claim 1 wherein each one of the double-valued card has a playing card value of eleven.

7. The playing cards of claim 1,wherein:

the first group of cards includes 20 single-valued cards; and the second group of cards includes 32 double-valued cards.

8. The playing cards of claim 7 wherein a face of each of the second group of cards includes a first and a second distinctive zones wherein each of the first and the second distinctive zones include different playing card values of a playing card suit selected from club, spade, diamond, and heart.

9. The playing cards of claim 7 wherein the playing card value on a face of each of the first group of cards is of a playing card suit selected from club, spade, diamond, and heart.

10. The playing cards of claim 7 wherein a face of each of the first group of cards includes a first and a second distinctive zones wherein each of the first and the second zones include a playing card value selected from the group ten, jack, queen, king and ace of a playing card suit selected from club, spade, diamond, and heart.

11. The playing cards of claim 10 wherein the playing card suits in the first and the second zones are the same.

12. The playing cards of claim 10 wherein the playing card values in the first and the second zones are the same.

13. The playing cards according to claim 7 wherein each double-valued card includes at least two playing card values ranging from deuce through nine such that the arithmetic total of the playing card values on each one of the double-valued card is eleven.

14. The playing cards of claim 1, wherein:

the first group of cards includes 36 single-valued cards; and the second group of cards includes 16 double-valued cards.

15. The playing cards of claim 14 wherein a face of each of the first group of cards includes a playing card value selected from the group deuce through five and from the group ten through ace of a playing card suit selected from club, spade, diamond, and heart.

16. The playing cards of claim 14 wherein a face of each of the first group of cards includes a first and a second distinctive zones wherein each of the first and the second zones include a playing card value selected from the group deuce through five and from the group ten through ace of a playing card suit selected from club, spade, diamond, and heart.

17. The playing cards of claim 16 wherein the playing card suits in the first and the second zones are the same.

18. The playing cards of claim 16 wherein the playing card values in the first and the second zones are the same.

19. The playing cards of claim 14 wherein a face of each of the second group of cards includes a first and a second distinctive zones wherein:

the first zone includes a playing card value selected from the group deuce through five of a playing card suit selected from club, spade, diamond, and heart; and the second zone includes a playing card value selected from the group six through nine of a playing card suit selected from club, spade, diamond, and heart.

20. A set of playing cards comprising:

a first group of cards including 20 single-valued cards having only one numerical playing card value indicated on each one of the single-value cards, wherein each single-value playing card value ranges from ten through ace; and a second group of cards comprising 16 double-valued cards having at least two numerically different playing card values indicated on each one of the double-valued cards, wherein each double-value playing card value ranges from deuce through nine.

21. A method for increasing the combinations of cards in a card game, the method comprising the steps of:

separating the cards into a first group of single-valued cards having only one numerical playing card value indicated on each one of the single-valued cards;

separating the cards into a second group of double-valued cards wherein each double-valued card includes at least two numerically different playing card values ranging from deuce through nine indicated thereon; and limiting to eleven the arithmetic total of the playing card values on each one of the double-valued card.

22. The method of claim 21 further comprising the step of assigning to a face of the first group of cards a playing card value selected from the group ten through ace of a playing card suit selected from club, spade, diamond, and heart.

23. The method according to claim 21 further comprising the step of declaring one or more playing card suit selected from club, spade, diamond and heart as ranking higher than the other.

24. The method according to claim 23 further comprising the step of associating the highest of the at least two playing card values on each double-valued card with the highest ranking playing card suit on said double-valued card.

25. The method according to claim 23 further comprising the step of associating the highest ranked playing card suit on each double-valued card with one of the at least two playing card values on said double-valued card.

26. The method according to claim 21 further comprising the step of declaring one or more playing card suit selected from club, spade, diamond and heart as ranking lower than the other.

27. The method according to claim 26 further comprising the step of associating the lowest of the at least two playing card values on each double-valued card with the lowest ranking playing card suit on said double-valued card.

28. The method of claim 21 further comprising the step of assigning a playing card value of eleven to each one of the double-valued cards.

29. The method of claim 21 further comprising the steps of;

defining a first and a second distinctive zones on a face of the first group of cards; and assigning to each of the first and the second zones a playing card value selected from the group ten through ace of a playing card suit selected from club, spade, diamond, and heart.

30. The method of claim 21 further comprising the steps of:

defining a first and a second distinctive zones on a face of the second group of cards; and assigning to each of the first and the second zones a playing card value selected from the group deuce through nine of a playing card suit selected from club, spade, diamond, and heart.

31. A method for playing a card game, the method comprising the steps of:

separating the cards into a first group of single-valued cards having only one numerical playing card value indicated on each one of the single-valued cards;

separating the cards into a second group of double-valued cards wherein each double-valued card includes at least two numerically different playing card values ranging from deuce through nine indicated thereon;

limiting to eleven the arithmetic total of the playing card values on each one of the double-valued card; and increasing the combination of choices for the playing card values deuce through nine.

32. A method for playing a card game, the method comprising the steps of:

separating the cards into a first group of single-valued cards having only one numerical playing card value indicated on each one of the single-valued cards;

separating the cards into a second group of double-valued cards wherein each double-valued card includes at least two numerically different playing card values ranging from deuce through nine indicated thereon;

limiting to eleven the arithmetic total of the playing card values on each one of the double-valued card; and doubling the combination of choices for the playing card value of deuce through nine.

33. A method for playing a card game, the method comprising the steps of:

separating the cards into a first group of single-valued cards having only one numerical playing card value indicated on each one of the single-valued cards;

separating the cards into a second group of double-valued cards wherein each double-valued card includes at least two numerically different playing card values ranging from deuce through nine indicated thereon;

limiting to eleven the arithmetic total of the playing card values on each one of the double-valued card; and decreasing the combinations of cards.

34. The method according to claim 33 further comprising the step of assigning to each double-valued card, a specific one of the two card values and card suits.

35. A method for playing a card game, the method comprising the steps of:

separating the cards into a first group of single-valued cards having only one numerical playing card value indicated on each one of the single-valued cards;

separating the cards into a second group of double-valued cards wherein each double-valued card includes at least two numerically different playing card values ranging from deuce through nine indicated thereon;

limiting to eleven the arithmetic total of the playing card values on each one of the double-valued card; and ranking the playing cards having the playing card values of ten through ace lower than the playing cards having the playing card values of deuce through nine.

36. A set of playing cards comprising:

means for grouping the cards into a first group of single-valued cards having only one numerical playing card value indicated on each one of the single-valued cards;

means for grouping the cards into a second group of double-valued cards wherein each double-valued card includes at least two numerically different playing card values ranging from deuce through nine indicated thereon; and means for limiting to eleven the arithmetic total of the playing card values on each of the double-valued cards.

37. A set of playing cards comprising means for increasing the combination of cards in a player's hand including:

means for grouping the cards into a first group of single-value cards having only one numerical playing card value indicated on each one of the single-valued cards;

means for grouping the cards into a second group of double-valued cards wherein each double-valued card includes at least two numerically different playing card values ranging from deuce through nine indicated thereon; means for limiting to eleven the arithmetic total of the playing card values on each one of the doubled-valued cards; and means for selecting one of the at least two playing card values for play from each double-valued card in the player's hand.

38. A set of playing cards comprising means for increasing the combination of cards in a player's hand including:

means for grouping the cards into a first group of single-valued cards having only one numerical playing card value indicated on each one of the single-valued cards;

means for grouping the cards into a second group of double-valued cards wherein each double-valued card includes at least two numerically different playing card values selected from deuce through nine indicated thereon; means for limiting to eleven the arithmetic total of the playing card values on each one of the double-valued cards; and means for selecting one of the at least two playing card values for play from each double-valued card in the player's hand.

39. A set of playing cards comprising means for doubling the combination of cards in a player's hand including:

means for grouping the cards into a first group of single-valued cards having only one numerical playing card value indicated on each one of the single-valued cards;

means for grouping the cards into a second group of double-valued cards wherein each double-valued card includes at least two numerically different playing card values selected from deuce through nine indicated thereon; means for limiting to eleven the arithmetic total of the playing card values on each one of the double-valued cards; and means for selecting one of the at least two playing card values for play from each double-valued card in the player's hand.

40. A set of playing cards comprising means for decreasing the combination of cards in a player's hand including:

means for grouping the cards into a first group of single-valued cards having only one numerical playing card value indicated on each one of the single-valued cards;

means for grouping the cards into a second group of double valued cards wherein each double-valued card includes at least two numerically different playing card values selected from deuce through nine indicated thereon; means for limiting to eleven the arithmetic total playing card values on each one of the double-valued cards; and means for selecting one of the at least two playing card values for play from each double-valued card in the player's hand.

41. A device for playing one or more card games, the device comprising:

a first group of cards including single-valued cards wherein each single-valued card includes only one numerical playing card value indicated thereon, and each single-valued card includes a playing card suit selected from club, spade, diamond, and heart; and a second group of cards including double-valued cards wherein each double-valued card includes at least two numerically different playing card values indicated thereon ranging from deuce through nine of one or more playing card suit selected from club, spade, diamond, heart, wherein the arithmetic total of the at least two playing card values on each one of the double-valued cards equals eleven.

42. The device according to claim 41 wherein each double-valued card is configured to display only one of the two card values on the face of the double-valued card.

43. The device of claim 41 wherein each double-valued card is configured such that only one of the two card values predominates the face of the double-valued card.

44. The device of claim 41 further comprising means for changing an overall ranking of the playing cards distributed to a player.

45. The device of claim 41 further comprising means for manipulating the device.

46. The device of claim 41 further comprising means for selecting one of the two card values and suits of a double-valued card.

47. The device according to claim 41 comprising an electronic device.

48. The device according to claim 41 including an electro-mechanical device.

49. The device of claim 41 comprising a mechanical device.

50. The device of claim 41 including a computer.

51. The device of claim 41 comprising a hand-held device.

52. The device of claim 51 wherein the hand-held device is an electronic device.

53. The device of claim 41 further comprising means for selecting the playing card value of eleven for the one or more double-valued card.

54. The device of claim 41 further comprising means for playing the one or more double-valued card as the playing card value of eleven.

* * * * *